United States Patent [19]

Monte

[11] 4,337,803

[45] Jul. 6, 1982

[54] METHOD OF RECHARGING FIRE EXTINGUISHER BOTTLES

[75] Inventor: Anthony J. Monte, Macomb, Mich.

[73] Assignee: The United States of America as represented by the Secretary of the Army, Washington, D.C.

[21] Appl. No.: 170,465

[22] Filed: Jul. 21, 1980

[51] Int. Cl.[3] ..... B65B 1/32

[52] U.S. Cl. ..... 141/2; 141/231

[58] Field of Search ..... 141/1, 2, 18, 83, 52, 141/85, 89, 90, 91, 92, 94, 231, 285, 290, 369, 372, 378

[56] References Cited

U.S. PATENT DOCUMENTS 4,053,001 10/1977 Healey et al. ..... 141/2

*Primary Examiner*—Frederick R. Schmidt

*Attorney, Agent, or Firm*—Peter A. Taucher; John E. Becker; Nathan Edelberg

[57] ABSTRACT

A method of recharging fire extinguisher bottles wherein special transfer cylinders are used to store and discharge predetermined quantities of liquid fire suppressant and pressurizing gas to the bottle; the process is carried out on a weight basis to minimize errors that would occur if the charging process were carried out on a pressure or volume basis. The invention is particularly applicable to the recharging of fire extinguisher bottles located in military vehicles without the necessity for first removing the bottles from the vehicles.

3 Claims, 6 Drawing Figures

Fig. 6
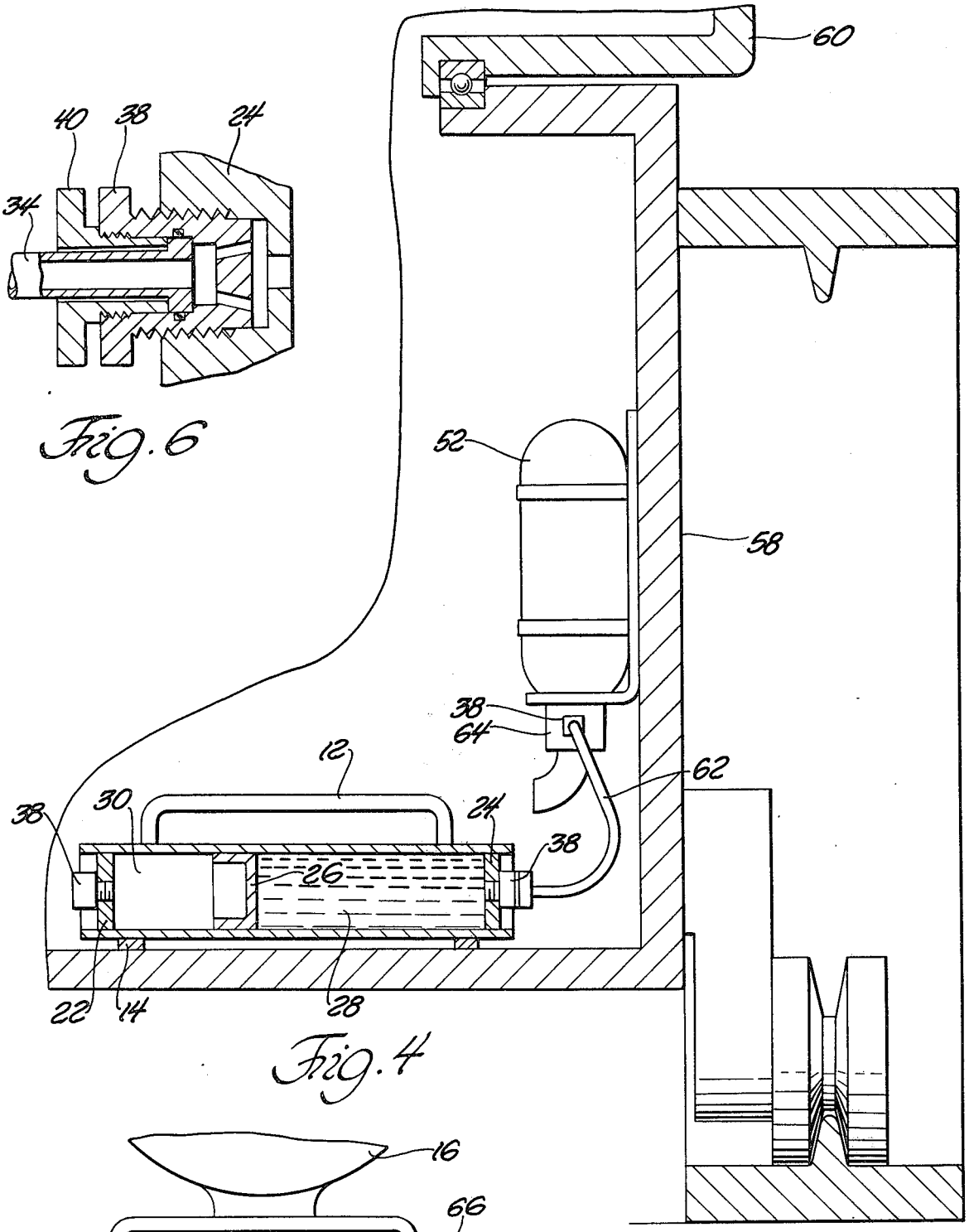
Fig. 4
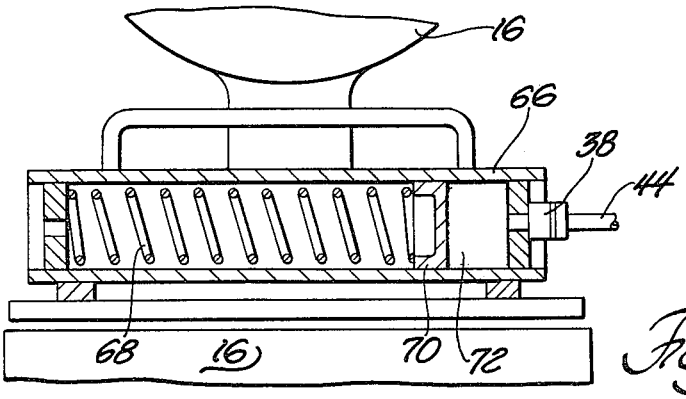
Fig. 5

METHOD OF RECHARGING FIRE EXTINGUISHER BOTTLES

GOVERNMENT INTEREST

The invention described herein may be manufactured, used and licensed by or for the Government for governmental purposes without payment to me of any royalty thereon.

BACKGROUND AND SUMMARY OF THE INVENTION

U.S. Pat. No. 3,915,237 to E. J. Rozniecki illustrates a fire extinguisher bottle containing liquid fire suppressant and installed in a military vehicle for suppression of near explosive fires caused by passage of enemy projectiles into the vehicle fuel tank. Similar bottles have been used to suppress slow growth fires resulting from debris accumulation or oil accumulations in vehicle crew compartments or engine compartments. Such bottles commonly utilize quick-opening discharge valves of the type shown in U.S. Pat. No. 3,491,783 to O. L. Linsalato. Commonly, an inert pressurized gas, such as nitrogen at 700 p.s.i., is charged into each bottle to provide the driving force for expelling the liquid from the bottle when an electrical signal is applied to the valve actuator.

The present invention is directed to a method of recharging such bottles, using one or more transfer cylinders to accurately meter into each bottle precise quantities of liquid fire suppressant and pressurizing gas on a weight basis. My invention is particularly suited for recharging fire extinguisher bottles in military vehicles without first having to remove the bottles from the vehicles. One advantage of my invention is that the rather heavy bottles do not have to be lifted through the vehicle turret and out the hatch, thus avoiding a potential skin burn hazard due to accidental discharge of liquid fire suppressant should the valve on the bottle strike an obstruction in the vehicle. Also, because there is no need to remove bottles from the vehicles there is a lesser inventory of charged bottles stored at the depot and lesser potential slow leakage associated with stored bottles; bottle maintenance costs should be somewhat less using my invention when compared to present practice. Another advantage of my invention is the elimination of charging inaccuracies that can occur when the liquid suppressant and pressurized gas are introduced on a pressure basis. Such inaccuracies are due to the effect of temperature variations and the characteristic of the pressurizing gas to dissolve slowly in the liquid fire suppressant over a prolonged time period so as to effectively lower the pressure from its initial charge-in value.

THE DRAWINGS

FIGS. 1–5 are elevational views of various items of apparatus used in the practice of my invention.

FIG. 6 is a fragmentary sectional view of a filler plug used in the apparatus shown in FIGS. 1–5.

Figure 1:
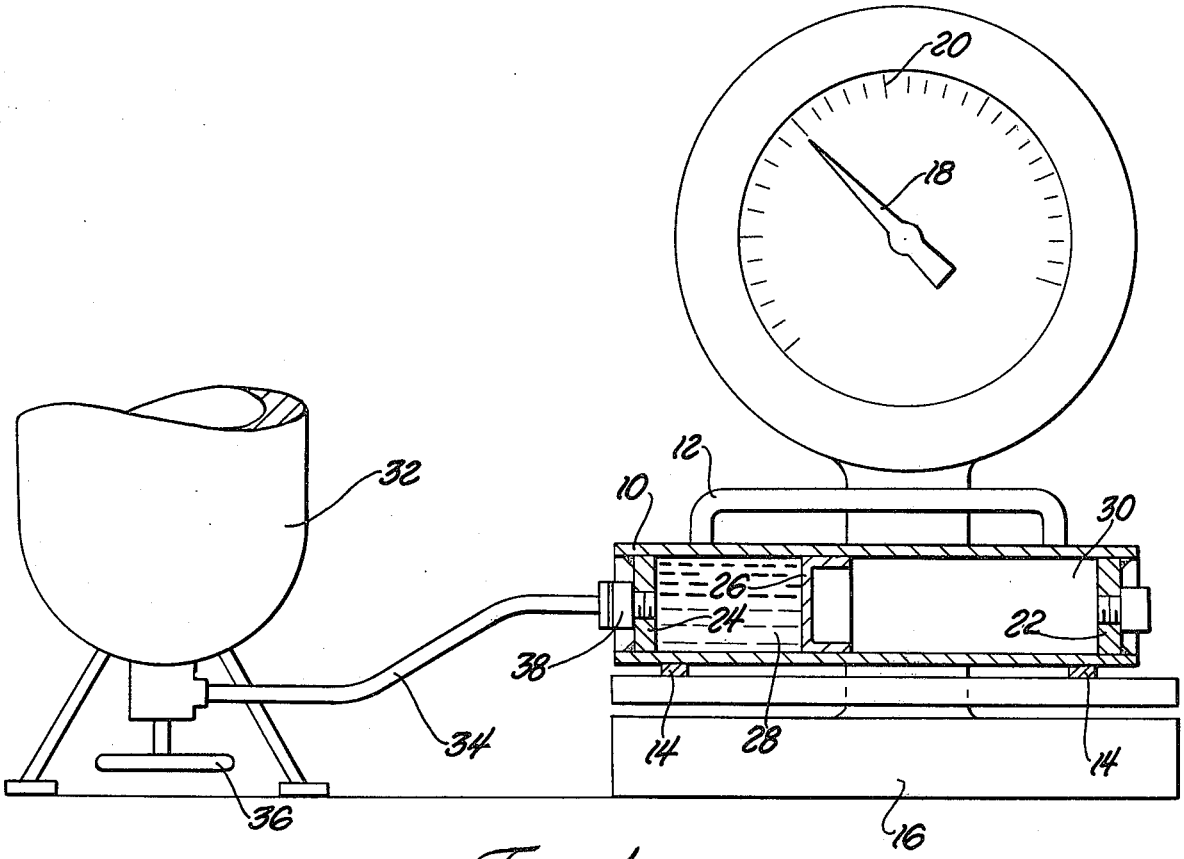
Figure 2:
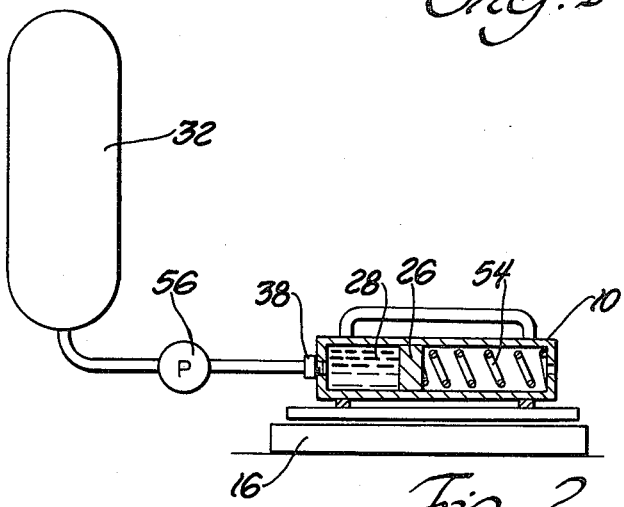
Figure 3:
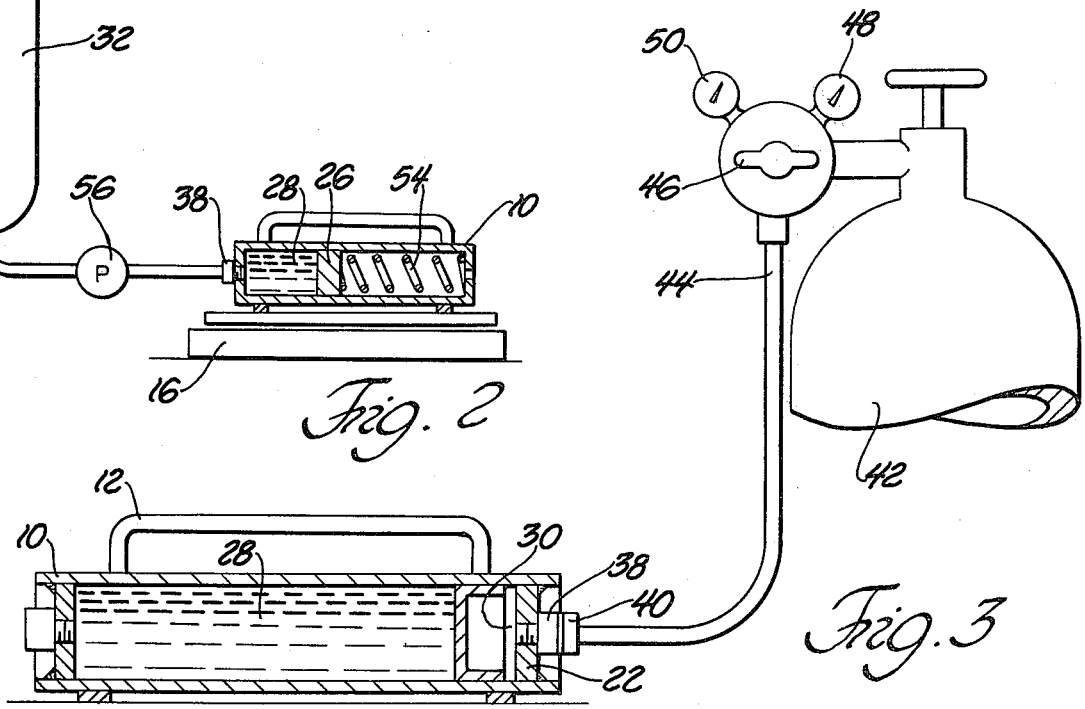

Referring more particularly to the drawings, FIG. 1 illustrates an apparatus for gravitationally delivering a predetermined mass of liquid fire suppressant from storage tank 32 to a transfer cylinder 10. FIG. 2 illustrates an alternate system for pumping liquid from the storage tank into a transfer cylinder equipped with a spring-urged piston. FIG. 3 shows how the transfer cylinder of FIG. 1 can be charged with a pressurized gas. The charged cylinders of FIGS. 2 and 3 can be transported into a military vehicle, as shown in FIG. 4, to transfer the liquid fire suppressant into a fire extinguisher bottle 52. FIG. 5 fragmentarily illustrates an arrangement for charging a predetermined mass of pressurized gas into a second transfer cylinder 66; the pressurized cylinder can subsequently be connected to bottle 52 to discharge the pressurized gas into the bottle. The apparatus of FIGS. 1 through 5 is designed to sequentially introduce predetermined weights of liquid fire suppressant and inert pressurizing gas into bottle 52 without removing the bottle from the vehicle.

Referring in greater detail to FIG. 1, there is shown a transfer cylinder 10 having a carrying handle 12 and feet 14 for supporting the cylinder on a weighing scale or machine 16, said weighing machine having the usual pointer 18 movable along dial graduations 20 to indicate the weight of cylinder 10 and its contents. Cylinder 10 is equipped with a right end wall 22, a left end wall 24, and a floating piston 26, said piston cooperating with the end walls to define separate chambers 28 and 30.

Chamber 28 is intended to be charged with a predetermined mass or weight of a conventional fire suppressant liquid, such as bromotrifluoromethane, from a storage tank 32 via a hose 34. In the FIG. 1 arrangement, the cylinder 10 is positioned near the lower end of tank 32 to permit gravity discharge of the liquid from the tank into chamber 28 when a conventional manual valve 36 is open. Hose 34 may be connected to cylinder end wall 24 by means of a filler plug 38 constructed generally similar to the filler plug in aforementioned U.S. Pat. No. 3,491,783, see FIG. 3. As shown in attached FIG. 6, filler plug 38 may be partially unthreaded from the tapped opening in wall 24 to provide a path for liquid flow from hose 34 to chamber 28. An auxiliary threaded collar 40 retains the hose 34 in sealed connection with plug 38.

Referring again to FIG. 1, plug 38 is maintained in an open condition until pointer 18 on the weighing mechanism undergoes a predetermined deflection representing a specific weight addition of liquid to chamber 28, e.g. 7 pounds; at that time, plug 38 is screwed into the tapped opening in cylinder end wall 24 to temporarily seal the liquid within chamber 28. Piston 26 is displaced rightwardly from its FIG. 1 position. The FIG. 1 system contemplates human observation of dial graduations 20 and human actuation of plug 38. An automatic system could be devised, based on weight-actuated electrical switch for controlling a solenoid valve located on wall 24.

FIG. 3 illustrates a mechanism for pressurizing the liquid in chamber 28, said mechanism comprising a thick-walled tank or bottle 42 containing a pressurized gas such as nitrogen. The bottle gas may be fed into a conduit 44 by manual turning force on the handle of a conventional valve 46 equipped with conventional pressure gauges 48 and 50. When the gauge 50 pressure reaches some suitable value, e.g. 200 p.s.i., filler plug 38 is closed to isolate conduit 44 from compartment 30. Chamber 30 will be pressurized to the gauge 50 reading in preparation for subsequent pumping of the fire suppressant liquid from chamber 28 to the fire extinguisher bottle 52 shown at FIG. 4.

FIG. 2 illustrates another method of supplying the pump force for expelling liquid from chamber 28. In this case piston 26 is continually urged leftwardly by a compression coil spring 54. A pump 56 delivers liquid fire suppressant from storage tank 32 into chamber 28 until the dial on weighing scale 16 indicates that the desired predetermined mass has been added to chamber 28; at that time pump 56 is de-energized and filler plug 38 is threaded inwardly to seal the liquid in chamber 28. The stored energy of spring 54 can subsequently be used to expell the liquid from chamber 28.

FIG. 4 shows the FIG. 3 transfer cylinder 20 after transportation to a location within the hull 58 of a tracked military vehicle equipped with a rotary turret 60. A short hose 62 is connected between filler plug 38 on end wall 24 and a similar filler plug on the valve 64 of bottle 52; valve 64 may be similar to the explosively-actuated valve shown in U.S. Pat. No. 3,491,783. High pressure gas in chamber 30 is sufficient to pump the liquid from chamber 28 through hose 62 into bottle 52. If the FIG. 2 transfer cylinder were used then spring 54 would provide the pumping action. Filler plug 38 controls the start and end of the pumping action.

After hose 62 is disconnected from the filler plug on bottle valve 64 a predetermined quantity of gas may be charged into the bottle through another hose connected between a gas pressure source and the bottle filler plug, thus pressurizing the bottle space above the fire suppressant liquid. During the charge-in process the gas bubbles upwardly through the liquid to form a pressurized space above the liquid surface in the bottle. Preferably, the quantity of gas admitted to bottle 52 is accurately metered, e.g. about 0.3 pounds of nitrogen per 7 pounds of liquid fire suppressant. FIG. 6 illustrates a filler plug mechanism 38 for charging a predetermined mass of pressurized gas into transfer cylinder 66 shown in FIG. 5. The cylinder is equipped with a compression spring 68 arranged to bias piston 70 in a rightward direction. Pressurized gas is delivered from a remote source through conduit 44, across filler plug 38 and into chamber 72 until the weighing scale 16 indicates a suitable weight addition, e.g. 0.3 pounds. Filler plug 38 is then screwed in to seal the pressurized gas in chamber 72. The FIG. 5 apparatus can be transported into the military vehicle and hose 44 connected to the bottle filler plug 38 to pressurize the bottle. Spring 68 is required to have a force sufficient to pump the entire 0.3 pounds of gas into bottle 52 (FIG. 4).

By way of recapitulation, FIG. 1 shows an apparatus for gravitationally delivering a predetermined mass of liquid fire suppressant from storage tank 32 to chamber 28 transfer cylinder 10. FIG. 3 illustrates an arrangement for introducing pressurized gas into chamber 30 of the FIG. 1 cylinder, thereby providing a source of stored energy for subsequently expelling the liquid fire suppressant into bottle 52 (FIG. 4). FIG. 2 illustrates a different arrangement wherein a predetermined mass of liquid suppressant is initially pumped into cylinder 10 against the force of spring 54; the spring provides a source of stored energy for subsequent ejection of the liquid suppressant into bottle 32. FIG. 5 shows a second transfer cylinder 66 for accepting a predetermined mass of a pressurized gas from a nonillustrated source; a spring 68 is utilized to subsequently eject the gas into bottle 52.

The invention provides a relatively quick method of accurately metering liquid and gas into bottle 52 without removing the bottle from the vehicle. Use of the invention avoids problems due to undesired temperature variations and slow dissolving of the pressurizing gas in the liquid suppressant; there is no requirement for jostling or moving bottle 52 back and forth to accelerate the dissolving action in order to achieve a stabilized pressure condition. The nature of my process is such that bottles 52 can be recharged in the field only when necessary, thereby obviating the need for maintaining a large inventory of charged bottles in the depot; this represents a cost savings in terms of lessened inventory and bottle storage area. Also, because there are fewer charged bottles in inventory there is less possibility for accidental discharge or slow leakage of fire suppressant liquid from stored bottles. The apparatus shown in the drawings can be carried on a truck and driven to locations in close proximity to a military vehicle when inspection indicates a need for bottle recharging.

I wish it to be understood that I do not desire to be limited to the exact details of construction shown and described for obvious modifications will occur to a person skilled in the art.

I claim:

1. A method of charging liquid fire suppressant and pressurized gas into a fire extinguisher bottle 52 equipped with a filler plug, said method being carried out with the use of two transfer cylinders 10, 66, each having a floating piston therein cooperating with the respective cylinders' end walls to define two separate chambers therein; said method comprising the steps of:

positioning one of the transfer cylinders on a weighing machine 16, and adding liquid fire suppressant into one of its two chambers until a predetermined weight of suppressant is in said one chamber;

connecting a first filler hose 34 between said one chamber and the filler plug 38 on said fire extinguisher bottle 52;

applyig a force to the floating piston and opening the filler plug to pump substantially all of the liquid suppressant through the hose into said bottle;

pressurizing said liquid suppressant by connecting a second filler hose 44 between the filler plug on the bottle and an independent source of pressurized gas; and opening the filler plug to admit a predetermined quantity of said pressurized gas to the bottle.

2. The method of claim 1, wherein the step of pressurizing the liquid suppressant includes:

utilizing a second transfer cylinder 66 also having a floating piston 70 therein cooperating with the cylinder end walls to define two separate chambers, one of said chambers having a compression spring 68 therein;

admitting highly pressurized gas into the other chamber 72 in the second transfer cylinder until a predetermined weight of gas is in said other chamber; and utilizing said compression spring as the means for driving the pressurized gas through the second filler hose 44 into the bottle 52 during said pressurizing.

3. The method of claim 1 or 2, wherein the fire extinguisher bottle 52 to be charged is located within a military vehicle; said method further including the steps of:

weighing said transfer cylinder outside of said vehicle, and transporting said transfer cylinder in contiguous association with the vehicle and its extinguisher bottle before the step of connecting the first filler hose to said transfer cylinder and to said bottle.

* * * * *